US009693147B2

(12) United States Patent
Kang

(10) Patent No.: US 9,693,147 B2
(45) Date of Patent: Jun. 27, 2017

(54) SENSORY SIGNAL OUTPUT DEVICE

(71) Applicant: YEIL ELECTRONICS CO., LTD., Incheon (KR)

(72) Inventor: Yoon Kyu Kang, Gyeonggi-do (KR)

(73) Assignee: YEIL ELECTRONICS CO., LTD., Incheon (KR)

( * ) Notice: Subject to any disclaimer, the term of this patent is extended or adjusted under 35 U.S.C. 154(b) by 4 days.

(21) Appl. No.: 14/913,644

(22) PCT Filed: Jan. 23, 2014

(86) PCT No.: PCT/KR2014/000644
§ 371 (c)(1),
(2) Date: Feb. 22, 2016

(87) PCT Pub. No.: WO2015/026022
PCT Pub. Date: Feb. 26, 2015

(65) Prior Publication Data

US 2016/0212547 A1 Jul. 21, 2016

(30) Foreign Application Priority Data

Aug. 21, 2013 (KR) ..... 10-2013-0099115

(51) Int. Cl.
*H04R 9/00* (2006.01)
*H04R 11/02* (2006.01)
(Continued)

(52) U.S. Cl.
CPC ..... *H04R 11/02* (2013.01); *B06B 1/045* (2013.01); *H04R 9/025* (2013.01); *H04R 9/066* (2013.01);
(Continued)

(58) Field of Classification Search
CPC .... H04R 9/00; H04R 29/003; H04R 2209/00; H04R 2209/41; H04R 9/025; H04R 9/027
(Continued)

(56) References Cited

U.S. PATENT DOCUMENTS 5,894,263 A * 4/1999 Shimakawa ..... G08B 6/00 381/400
6,492,899 B1 * 12/2002 Yamaguchi ..... B06B 1/045 340/398.1
(Continued)

FOREIGN PATENT DOCUMENTS

JP 2001-189995 7/2001
JP 2008-048079 2/2008
(Continued)

*Primary Examiner* — Suhan Ni
(74) *Attorney, Agent, or Firm* — I P & T Group LLP

(57) ABSTRACT

A sensory signal output apparatus, and more particularly to a sensory signal output apparatus includes a bone conduction output apparatus, the sensory signal output apparatus including: the magnetic circuit part 110; the coil part 120; and the case 101 in which the magnetic circuit part and the coil part are accommodated, wherein the sensory signal output apparatus generates a sound or vibration while vibrating, by the magnetic circuit part, depending on a direction of an alternating signal applied to the coil part. The case elastically supports the magnetic circuit part and the coil part so that the magnetic circuit part and the coil part are operated to repeal or attract each other, or in a state where one of the magnetic circuit part and the coil part is fixed, the other vibrates while performing a repulsion or attraction motion.

14 Claims, 9 Drawing Sheets

(51) Int. Cl.
*B06B 1/04* (2006.01)
*H04R 9/02* (2006.01)
*H04R 9/06* (2006.01)

(52) U.S. Cl.
CPC ..... *H04R 2400/03* (2013.01); *H04R 2400/07* (2013.01); *H04R 2499/11* (2013.01)

(58) Field of Classification Search
USPC ..... 381/396, 400–401, 412, 417–421
See application file for complete search history.

(56) References Cited

U.S. PATENT DOCUMENTS

| | | | | |
|---|---|---|---|---|
| 7,593,540 | B2 * | 9/2009 | Itakura ..... | H01F 7/066 381/412 |
| 9,025,798 | B2 * | 5/2015 | Saint Vincent ..... | H04R 1/24 381/401 |
| 2002/0064295 | A1 | 5/2002 | Kobayashi et al. | |

FOREIGN PATENT DOCUMENTS

| | | |
|---|---|---|
| KR | 1020040100198 | 12/2004 |
| KR | 1020050021102 | 3/2005 |
| KR | 1020050106482 | 11/2005 |
| KR | 1020100097869 | 9/2010 |
| KR | 101467500 | 12/2014 |

* cited by examiner

SENSORY SIGNAL OUTPUT DEVICE

TECHNICAL FIELD

The present invention relates to a sensory signal output apparatus, and more particularly to a sensory signal output apparatus including a bone conduction output apparatus, the sensory signal output apparatus being configured such that a case itself in which a coil part and a magnetic circuit part are accommodated elastically supports a vibration structure formed by the coil part and the magnetic circuit part.

BACKGROUND ART

Generally, a sensory signal output apparatus is an apparatus outputting an acoustic or vibration force, such as a speaker, a receiver, a buzzer, and a vibration motor (vibrator) outputting a sound or generating a vibration force by converting an electrical signal inputted from a signal source into a mechanical signal. A bone conduction output apparatus corresponds also to this sensory signal output apparatus.

The sensory signal output apparatus can be applied to various fields according to a size and purpose. In particular, as touch screen phones have become popular, application of a small sensory signal output apparatus, which is widely used for vibration calling for a communication terminal according to the development of information and communication industry, especially, a small vibration motor such as a linear vibration motor having a function beyond a function of the existing rotatory vibration motor, has been rapidly increasing (the conventional vibration motor mainly having a mode that a vibrating screen vibrates while rotating).

The reason why application of the linear vibration motor to portable IT devices, such as touch screen phones including smarts phones, general cellular phones and the like has been extended is because the linear vibration motor has a rapid response speed, a small noise, and a largely improved product life compared with a rotatory vibration motor.

The response speed refers to a time how long it takes the vibration motor to reach 50% of a vibration force at a maximal displacement, and the largest reason for adopting the linear vibration motor is due to the response speed.

As touch screen phones have been recently evolved into smart phones, various applications have been used in the touch screen phones. These applications perform various functions and need feedback vibrations according to the functions. To satisfy the requirement, the development of a vibration motor having a faster response speed than that of the conventional linear vibration motor has been required in the relevant technical field.

The linear vibration motor is distinguished from a vibration motor in which a brush and a commutator are used. The driving principles of the linear vibration motor are based on the Fleming's left-hand law that a conductor that is placed in a magnetic field experience a force in a certain direction. That is, when an AC signal is applied to a fixed coil, the coil generates vibration energy by causing the motion of a magnet, which is a vibrator, according to the direction of an electric current and the size of a frequency.

The conventional linear vibration motor, as illustrated in FIG. 1 of the accompanying drawings, is configured such that a coil 6 is positioned with a distance (gap) in an outward direction or an inward direction of a magnet 4 and a top plate 5 sequentially and fixedly laminated on an upper surface of a yoke 3 using welding, bonding or insertion fixing with the yoke 3 so that a magnet circuit generates a vibration force while vibrating, wherein the magnet circuit reacts to a magnetic flux formed in a gap according to the direction of an alternating signal applied to the coil 6 and includes the magnet 4 and the top plate 5 (the magnet circuit may also include the yoke and/or a weight body depending on a function and design).

In this case, the magnet 3 and the top plate 4 are divided as the magnetic circuit, and the coil 6 is divided as a vibration induced part.

A sensory signal output apparatus having this structure is generally accommodated in a closure type case 1 and cover 2 such that the magnetic circuit including the yoke 6 on which the magnet 4 and the top plate 5 are fixedly seated is supported by a separate leaf spring 7 and is fixed to the case 1 (e.g., rivet 8 fixing, welding fixing, or injection fixing to the case).

However, the conventional sensory signal output apparatus described above is problematic in that a whole volume (size) of the sensory signal output apparatus is increased because the leaf spring 7 supporting the magnetic circuit is disposed in the case 1, and thus a space or a distance for movement of the leaf spring 7 should be secured in the case 1.

In addition, since the conventional sensory signal output apparatus needs work for performing rivet 8 fixing, welding fixing, or injection fixing of the leaf spring 7 to the case 1, manufacturing work is inconvenient and difficult, thereby it is also problematic in that manufacturing properties are reduced.

Also, in the conventional sensory signal output apparatus, since a vibration generated from a vibration structure formed by the coil 6 and the magnetic circuit is transmitted to the case 1 via the leaf spring 7, the vibration force generated from the vibration structure is decreased during a transmission process to a device for which the vibration force is ultimately output, for example, a smart phone, an MP3, a notebook, or the like. Thus, it is problematic in that output efficiency is low.

These problem become more serious in a case, for which a fine vibration force is required, such as a bone conduction output apparatus.

The following documents introduce conventional arts such as the sensory signal output apparatus, and the conventional arts published in this document also have the problems as described above.

Document 1: Korean Patent Laid-Open Publication No. 10-2005-0106482 (Application Number: 10-2005-7016399 (Sep. 2, 2005); Bone Conduction Apparatus)

Document 2: Korean Patent Laid-Open Publication No. 10-2005-0021102 (Application Number: 10-2003-0059198 (Aug. 26, 2003); Diaphragm for Micro Speaker and Micro Speaker Using the Same)

DISCLOSURE

Technical Problem

Accordingly, the present invention has been made keeping for solving the above problems occurring in the conventional art, and the present invention is intended to propose a sensory signal output apparatus which is configured such that a case itself in which a coil part and a magnetic circuit part are accommodated elastically supports a vibration structure formed by the coil part and the magnetic circuit part.

Technical Solution

In order to achieve the above object, according to one aspect of the present invention, there is provided a sensory signal output apparatus, including: a magnetic circuit part 110; a coil part 120; and a case 101 in which the magnetic circuit part 110 and the coil part 120 are accommodated, wherein the sensory signal output apparatus 100 generates a sound or vibration while vibrating, by the magnetic circuit part 110, depending on a direction of an alternating signal applied to the coil part 120 in the state where the magnetic circuit part 110 and the coil part 120 are accommodated in the case 101 at corresponding positions, and wherein the case 101 elastically supports the magnetic circuit part 110 and the coil part 120 so that the magnetic circuit part 110 and the coil part 120 are operated to repeal or attract each other, or so that in a state where one of the magnetic circuit part 110 and the coil part 120 is fixed, the other vibrates while performing a repulsion or attraction motion.

Advantageous Effects

According to the present invention for solving the above problems, since the case 101 elastically support the magnetic circuit part 110 and the coil part 120 while receiving the magnetic circuit part 110 and the coil part 120, a vibration structure can be supported even without a separate leaf spring, thereby the whole constitutive elements or structure of the sensory signal output apparatus 100 can be simplified. Further, since it is not necessary to secure a space for the movement of a leaf spring in the case, a volume (size) of the sensory signal output apparatus 100) can be reduced up to the extent of a size corresponding to the corresponding space.

In addition, since the present invention does not require a separate leaf spring, a fixation process of the leaf spring to the case can be omitted, thereby it is effective for improving manufacturing efficiency.

Also, according to the present invention, since a vibration generated from a vibration structure formed by the magnetic circuit part 110 and the coil part 120 is directly transmitted to, for examples, a smart phone, an MP3, a laptop computer, or the like, which is intended to ultimately output a vibration force via the case 101, without going through a leaf spring, it is effective for preventing the vibration from being diminished and improving output efficiency.

DESCRIPTION OF THE REFERENCE NUMERALS IN THE DRAWINGS

Figure 1:
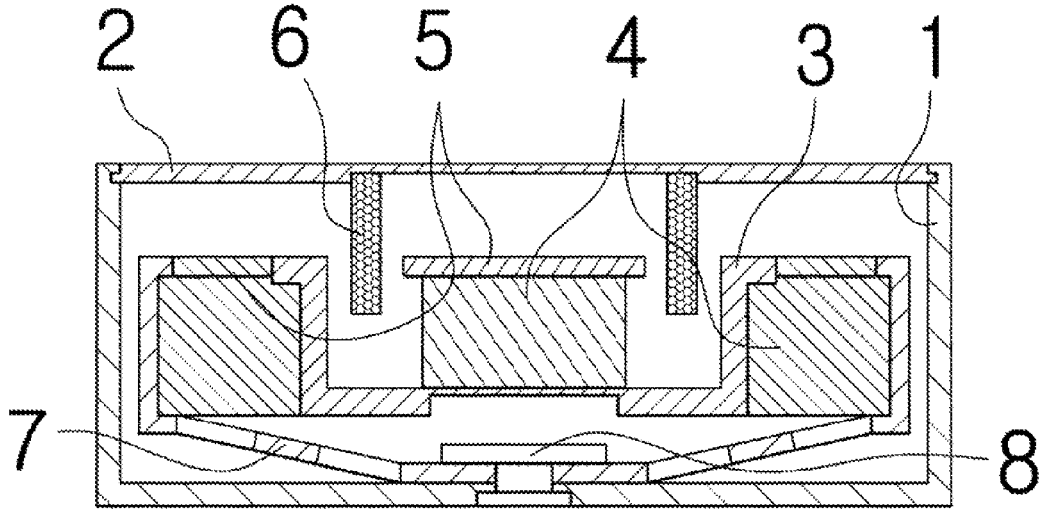
FIG.1 (PRIOR ART)
FIG. 1 is a cross-sectional view illustrating the configuration of a conventional sensory signal output apparatus.
Figure 2:
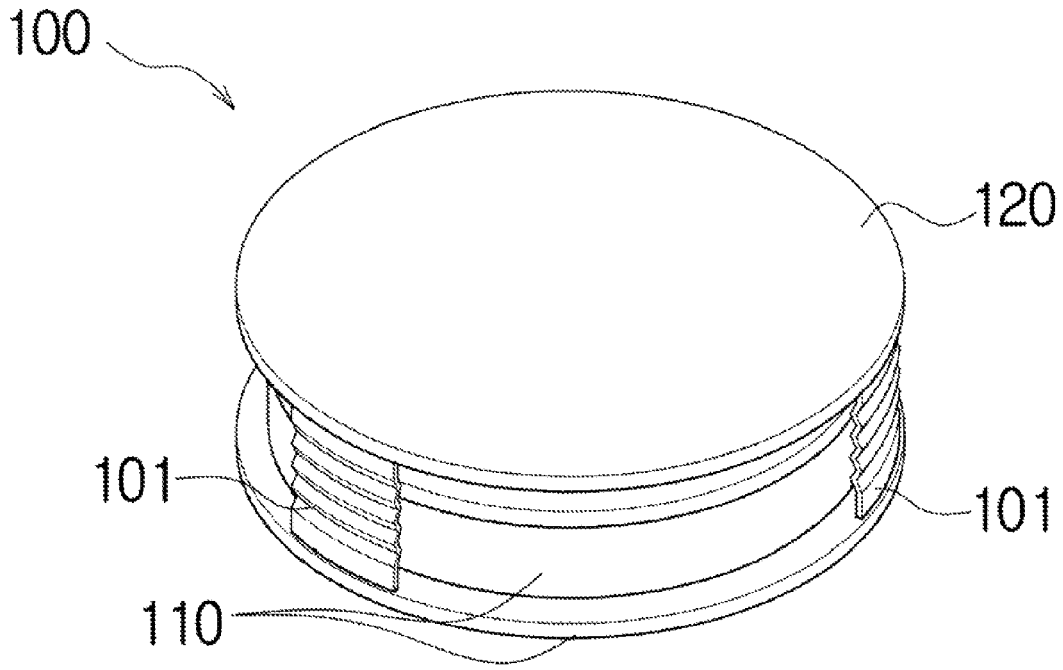
FIG. 2 is a perspective view illustrating the configuration of a sensory signal output apparatus according to one embodiment (first embodiment) of the present invention.
Figure 3:
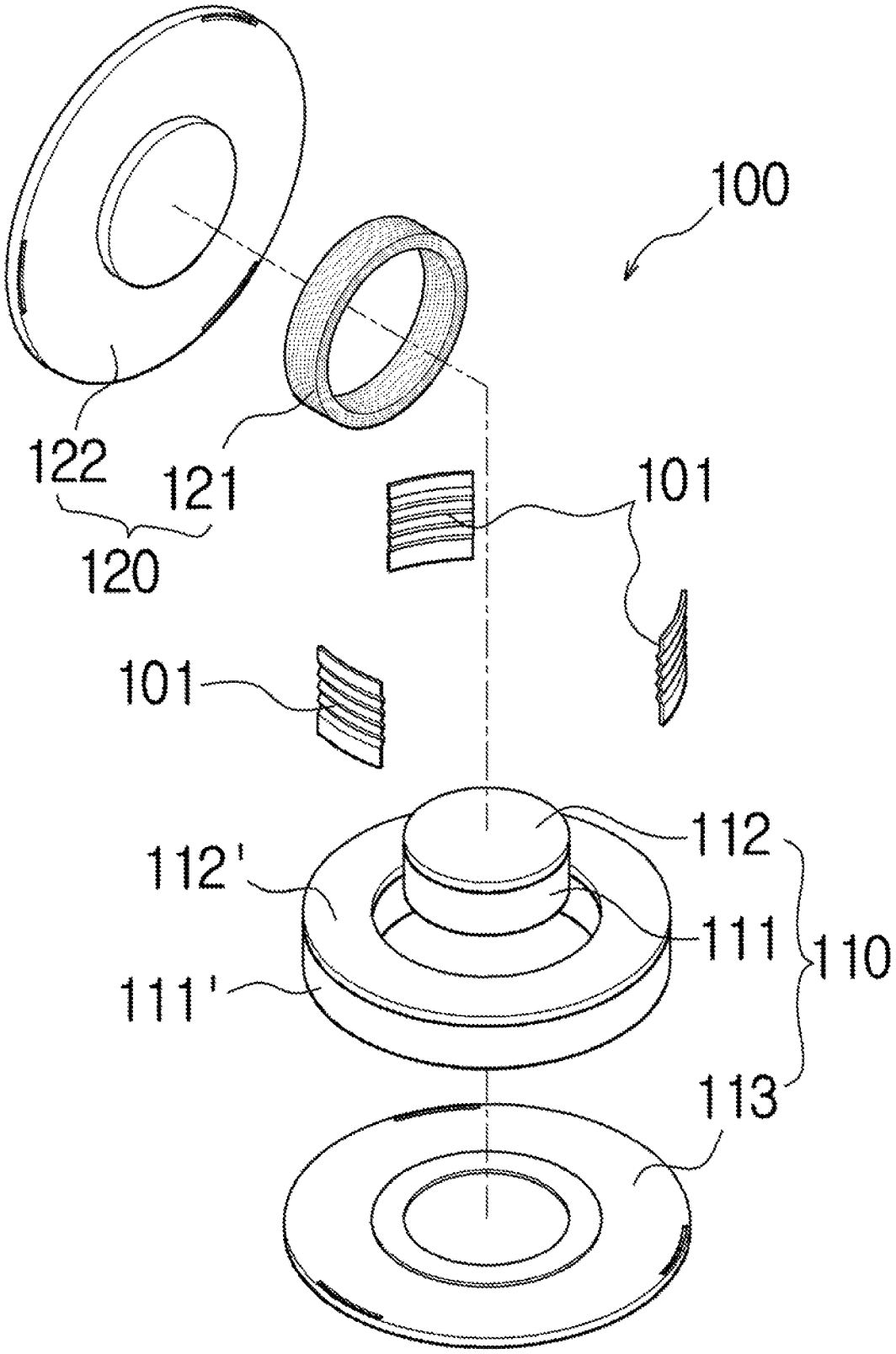
FIG. 3 is an exploded perspective view illustrating, in greater detail, the configuration of the sensory signal output apparatus according to one embodiment (first embodiment) of the present invention.
Figure 4:
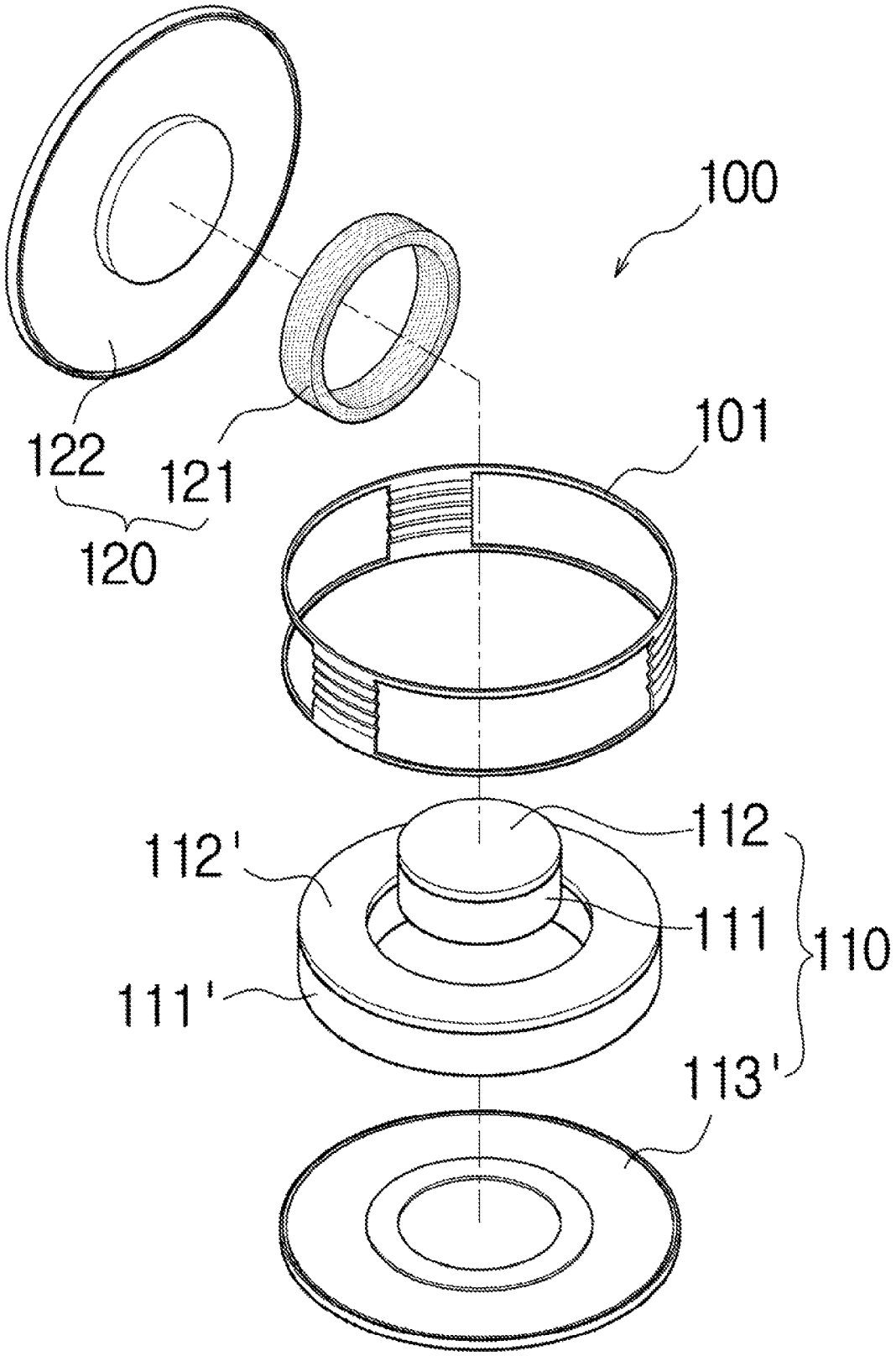
FIG. 4 is a cross-sectional view illustrating another configuration of the sensory signal output apparatus according to one embodiment (first embodiment) of the present invention.
Figure 5:
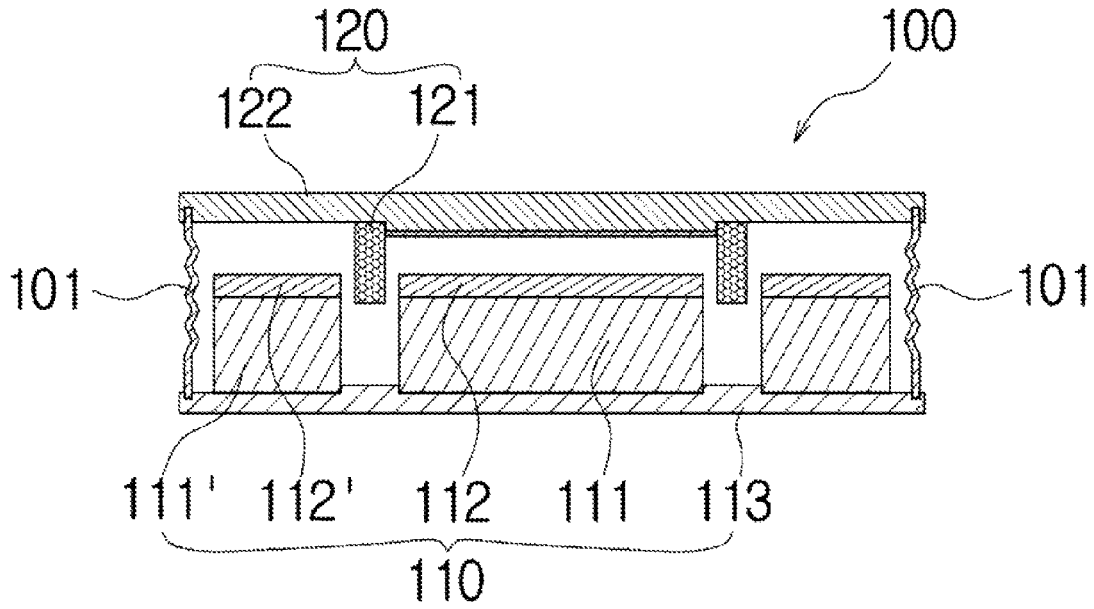
FIG. 5 is a cross-sectional view illustrating the detailed configuration of the sensory signal output apparatus according to one embodiment (first embodiment) of the present invention.

| | |
|---|---|
| 100: Sensory signal output device | 101: Case |
| 110: Magnetic circuit part | 111, 111': Magnets |
| 112, 112': Top plate | 113, 113': Yoke |
| 122: Plate | 123: Diaphragm |
| 124: Support member | 125: Cover |

BEST MODE

The present invention will be hereinafter described in detail with reference to the accompanying drawings.

First, explaining the configuration of a sensory signal output apparatus according to one embodiment (first embodiment) of the present invention, as illustrated in FIGS. 2 to 6 of the accompanying drawings, a sensory signal output apparatus 100 generates a sound or vibration while vibrating, by the magnetic circuit part 110, depending on a direction of an alternating signal applied to the coil part 120 in the state where the magnetic circuit part 110 and the coil part 120 are accommodated in the case 101 at corresponding positions.

The case 101 elastically supports the magnetic circuit part 110 and the coil part 120 so that the magnetic circuit part 110 and the coil part 120 can be operated to repeal or attract each other, or in a state of one of the magnetic circuit part 110 and the coil part 120 being fixed, the other can vibrate while performing a repulsion or attraction motion.

In this case, the magnetic circuit part 110 of the present invention, as illustrated in FIGS. 2 to 5 of the accompanying drawings, may include: a magnet 111 generating a magnetic force; a top plate 112 laminated on an upper surface of the magnet and adopted to concentrate the magnetic force of the magnet; another magnet 111' and another top plate 112' having a concentric circle with the magnet 111 and the top plate 112 and disposed in an outer portion at a regular interval; and a yoke 113 positioned to have the concentric circle and adopted to provide a surface on which the magnets are seated, and a passage through which a line of magnetic force passes.

Figure 6:
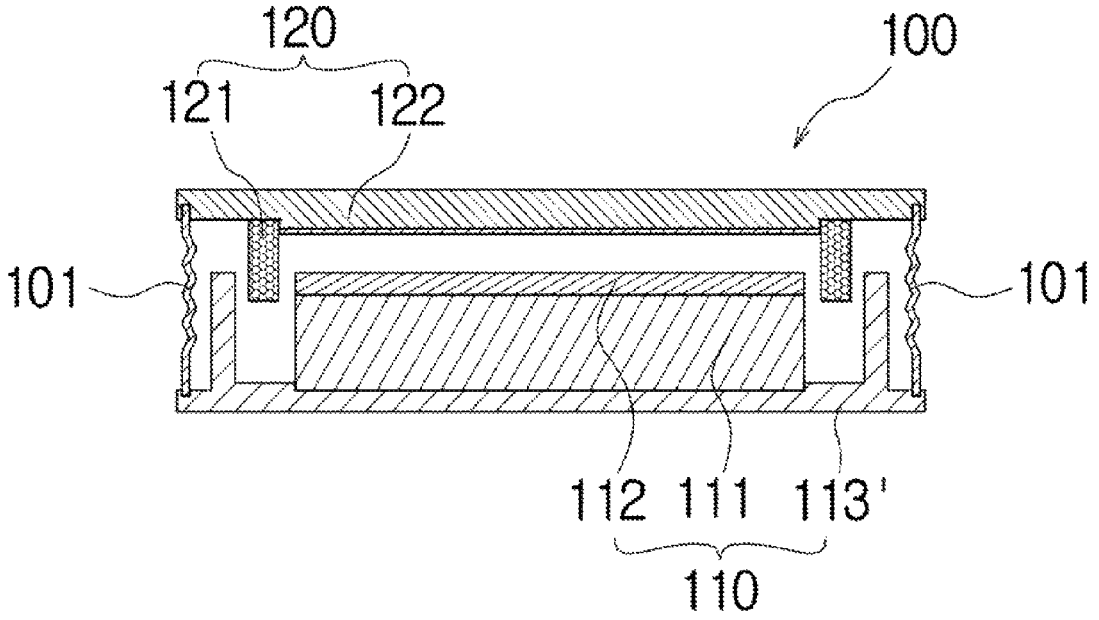
FIG. 6 is a cross-sectional view illustrating a further configuration of the sensory signal output apparatus according to one embodiment (first embodiment) of the present invention.

Further, the magnetic circuit part 110, as illustrated in FIG. 6 of the accompanying drawings, may include: the magnet 111 generating a magnetic force; the top plate 112 laminated on the upper surface of the magnet 111 and adopted to concentrate the magnetic force of the magnet; a yoke 113' adopted to provide a surface on which the magnet 111 is fixedly seated, and a passage through which a line of magnetic force passes, the yoke having a height surface so as to provide a gap having a magnetic flux formed in a direction of an outer circumferential surface or an inner circumferential surface.

Meanwhile, the coil part 120 may include a voice coil 121 vibrating according to the Fleming's left-hand law in a state of being positioned at the gap of the magnetic circuit part 110 when an alternating signal is input from the outside.

In addition, the coil part 120 may further include a plate 122 to which the voice coil 121 is fixed in the center of one surface.

Further, the case 101 may be an elastic plate body in a vertical direction, the elastic plate body being connected to an edge portion of a surface between the magnetic circuit part 110 and the coil part 120 and being made of a metal material or a synthetic resin material.

In this case, the case 101 may be a plate-body shaped leaf spring arrangement connected to the edge portion of the surface between the magnetic circuit part 110 and the coil part 120 at a regular interval (see FIG. 3); a rim-shaped leaf spring connected to the edge portion of the surface between the magnetic circuit part 110 and the coil part 120, and having a pierced portion and an elastic portion arranged on a surface thereof at an interval (see FIG. 4); or a rim-shaped leaf spring connected to the edge portion of the surface between the magnetic circuit part 110 and the coil part 120, and having elasticity (complete rim type having no pierced portion).

In the above case, although it is exemplified that the number of the leaf spring arrangements, which are arranged as an example, is 3-6, it is not limited thereto. The number of the leaf the leaf spring arrangements may be increased depending on the level of a magnetic force, an object to which the sensory signal output apparatus is used, or the like.

In addition, a surface of the leaf spring may be provided with a crumple zone providing an elastic force or a curved surface in an outward direction or an inward direction.

In the above case, a surface facing the coil part 120 of the magnetic circuit part 110 may be one surface of the yoke 113 on which the magnet 111 is fixedly seated, and a surface facing the magnetic circuit part 110 of the coil part 120 may be one surface of the plate 122 to which the voice coil 121 is fixed.

In addition, the case 101 may be inserted into and connected to a groove formed in the surface facing the magnet circuit part 110 and the coil part 120, or may be fixed by welding or bonding after being inserted.

In this case, a surface facing the coil part 120 of the magnetic circuit part 110 may be one surface of the yoke 113 on which the magnet 111 is fixedly seated, and a surface facing the magnetic circuit part 110 of the coil part 120 may be one surface of the plate 122 to which the voice coil 121 is fixed.

The operation of the present invention configured as described above will be hereinafter described.

First, explaining the operation of the configuration of the sensory signal output apparatus according to one embodiment (first embodiment) of the present invention, the sensory signal output apparatus 100 includes: the magnetic circuit part 110; the coil part 120; and the case 101 in which the magnetic circuit part 110 and the coil part are accommodated, wherein the sensory signal output apparatus 100 generates a sound or vibration while vibrating, by a magnetic circuit part 110, depending on a direction of an alternating signal applied to the coil part 120 in the state where a magnetic circuit part 110 and a coil part 120 are accommodated in the case 101 at corresponding positions, and wherein the case 101 elastically supports the magnetic circuit part 110 and the coil part 120 so that the magnetic circuit part 110 and the coil part 120 are operated to repeal or attract each other, or in a state where one of the magnetic circuit part 110 and the coil part 120 is fixed, the other vibrates while performing a repulsion or attraction motion.

In this case, the magnetic circuit part 110 may include: the magnet 111 generating a magnetic force; the top plate 112 laminated on an upper surface of the magnet 111 and adopted to concentrate the magnetic force of the magnet; another magnet 111' and another top plate 112' having a concentric circle with the magnet 111 and the top plate 112 and disposed in an outer portion at a regular interval; and the yoke 113 positioned to have the concentric circle and adopted to provide a surface on which the and magnets are seated, and a passage through which a line of magnetic force passes.

Meanwhile, in the present invention, the coil part 120 may include the voice coil 121 vibrating according to the Fleming's left-hand law in a state of being positioned at the gap of the magnetic circuit part 110 when an alternating signal is input from the outside. The coil part 120 may further include the plate 122 to which the voice coil 121 is fixed in the center of one surface.

Figure 7:
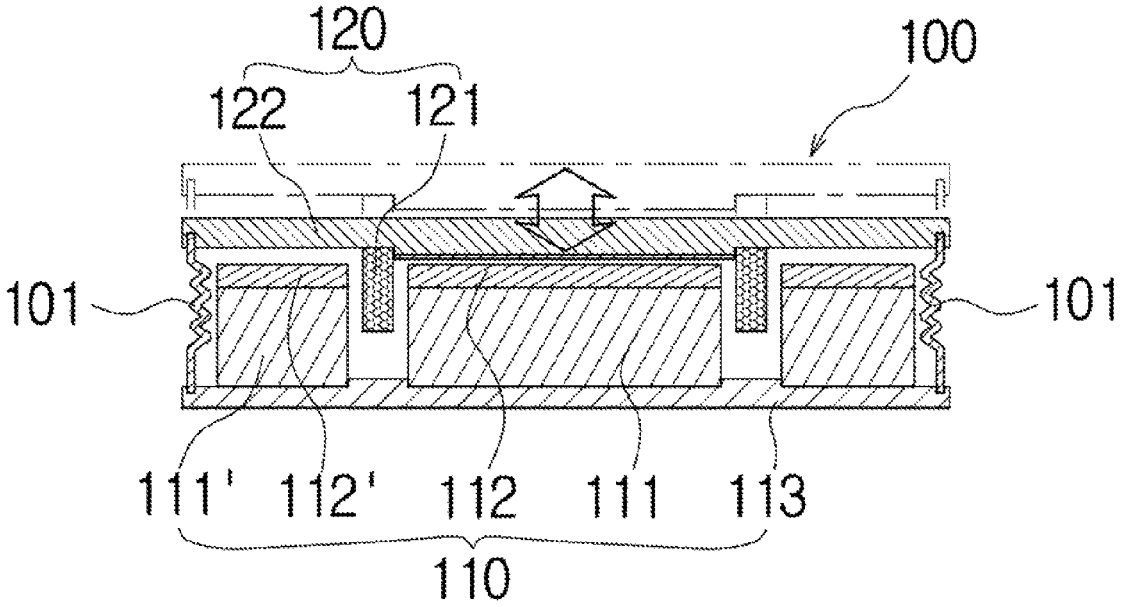
FIG. 7 is a cross-sectional view illustrating an operational state of the sensory signal output apparatus according to one embodiment (first embodiment) of the present invention.

According to the present invention configured as described above, the voice coil 121 is positioned in the gap between the pair of magnets 111, 111' seated on the yoke 113, and the top plates 112, 112', and at this time, as illustrated in FIG. 7, the magnetic circuit part including the yoke 113, magnets 111, 111' and the top plates 112, 112', and the coil part including the voice coil 121 generate a vibration force while vibrating by responding to a magnetic flux formed in the gap according to a direction of an alternating signal applied to the voice coil 121.

In this case, when one of the magnetic circuit part 110 and the coil part 120 is fixed, the other, which is not fixed, outputs a vibration force and/or sound while vibrating.

The vibration described above may be realized thanks to the fact that the magnetic circuit part 110 and the coil part 120 are elastically supported by the case 101 while being connected to the case 101 having elasticity at an interval.

That is, the vibration may be realized by an elastic support force generated from the case 101 erectly located between the magnetic circuit part 110 and the coil part 120.

According to the present invention configured as described above, since the case elastically supports the magnetic circuit part 110 and the coil part 120 while receiving the magnetic circuit part 110 and the coil part 120, a vibration structure may be supported without a separate leaf spring so that the whole constituent elements or structures of the sensory signal output apparatus 100 can be simplified. Furthermore, since there is no need to secure a space for the movement of a leaf spring, a volume (size) of the sensory signal output apparatus 100 can be reduced up to the extent of a size corresponding to the space.

In addition, since the present invention does not require a separate leaf spring, a fixation process of the leaf spring to the case can be omitted, thereby it is effective for improving manufacturing efficiency.

Also, according to the present invention, since a vibration generated from a vibration structure formed by the magnetic circuit part 110 and the coil part 120 is directly transmitted to, for examples, a smart phone, an MP3, a laptop computer, or the like, which is intended to ultimately output a vibration force via the case 101, without going through a leaf spring, it is effective for preventing the vibration from being diminished and improving output efficiency.

Another embodiment of the present invention configured as described above will be hereinafter reviewed.

Figure 8:
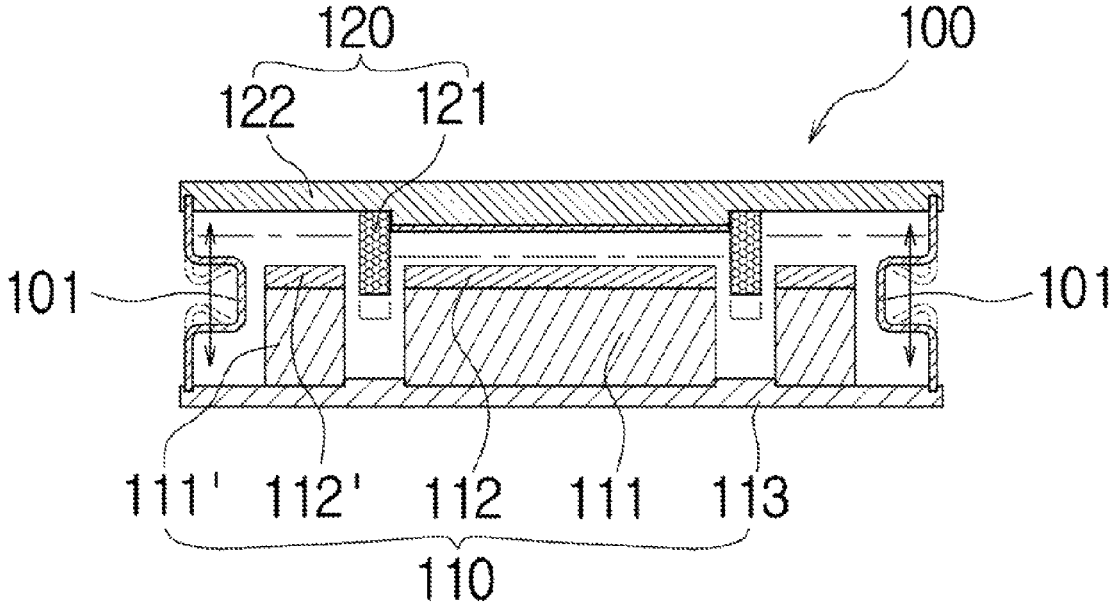
FIG. 8 is a cross-sectional view illustrating the configuration of a sensory signal output apparatus according to another embodiment (second embodiment) of the present invention.

First, reviewing the second embodiment of the present invention, as illustrated in FIG. 8 of the accompanying drawings, the case 101 may be a leaf spring connected to the edge portion of the surface between the magnetic circuit part 110 and the coil part 120 at an interval, and having a plate body whose center portion is bent to protrude in an inward direction; a rim-shaped leaf spring connected to the edge portion of the surface between the magnetic circuit part 110 and the coil part 120, and having a rim whose center portion is bent to protrude in an inward direction (complete rim type having no pierced portion).

In this case, the bent portion may be created by performing bending in a "[illegible]"-like shape, a "[illegible]"-like shape, or a ">"-like shape.

Figure 9:
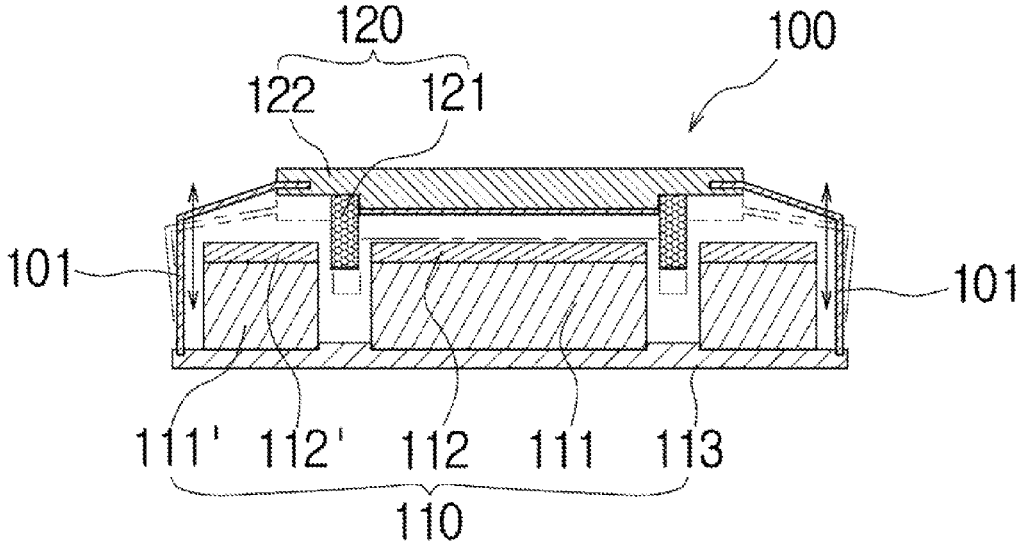
FIG. 9 is a cross-sectional view illustrating the configuration of a sensory signal output apparatus according to a further embodiment (third embodiment) of the present invention.

Next, reviewing the third embodiment of the present invention, as illustrated in FIG. 9 of the accompanying drawings, the case 101 may be a leaf spring connected to the edge portion of the surface between the magnetic circuit part 110 and the coil part 120 at an interval, and having a plate body whose center portion is bent to protrude in an outward direction; a rim-shaped leaf spring connected to the edge portion of the surface between the magnetic circuit part 110 and the coil part 120, and having a rim whose center portion is bent to protrude in an outward direction, and a pierced portion and an elastic portion arranged on a rim at an interval (see FIG. 4); or a leaf spring connected to the edge portion of the surface between the magnetic circuit part 110 and the coil part 120, and having a rim whose center portion is bent to protrude in an outward direction (complete rim type having no pierced portion).

In this case, the bent portion may result from performing bending in a "[illegible]"-like shape or a "[illegible]"-like shape.

As such, depending on the direction of an alternating signal applied to the voice coil 121 located between the pair of magnets 111, 111' and the top plates 112, 112', as illustrated, the magnetic circuit part 110 including the yoke 113, the magnets 111, 111' and the top plates 112, 112', and the coil part 12 including the voice coil 121 generate a vibration force while vibrating. This vibration may be realized by an elastic support force of the case erectly located between the magnetic circuit part 110 and the coil part 120.

Figure 10:
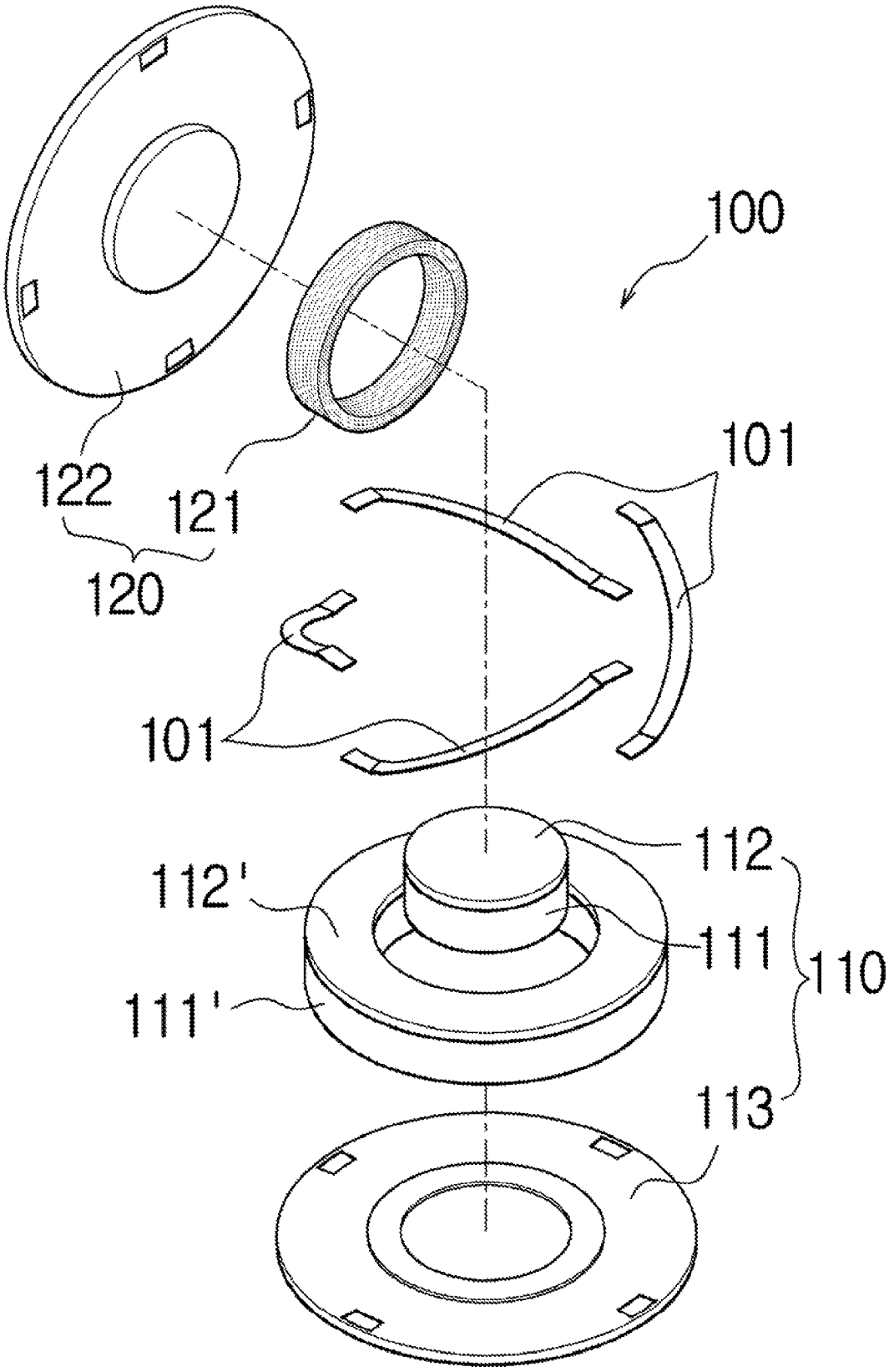
FIG. 10 is an exploded perspective view illustrating the configuration of a sensory signal output apparatus according to a yet another embodiment (fourth embodiment) of the present invention.

Next, reviewing Example 4 of the present invention, as illustrated in FIG. 10 of the accompanying drawings, the case 101 may be an inclined leaf spring arrangement made of a metal material or a synthetic resin material, one of which is connected to a surface facing the coil part 120 of the magnetic circuit part 110, and another end of which diagonally extends along an outer edge line of the magnetic circuit part 110 and the coil part 120, thereby the inclined spring arrangement being connected to the surface facing the magnetic circuit part 110 of the coil part 120.

In the above, it is exemplified that the number of the arranged inclined leaf springs is 3 to 6 as one example. The number of the arranged inclined leaf springs may be increased according to the extent of a magnetic force, an object in which the sensor signal output apparatus is used, or the like.

As such, according to the principle as described above, the magnetic circuit part 110 including the yoke 113 the magnets 111, 111', and the top plates 112, 112', and the coil part 120 including the voice coil 121 vertically vibrate while being horizontally rotated by the case 101, which is diagonally arranged, within a predetermined range.

Figure 11:
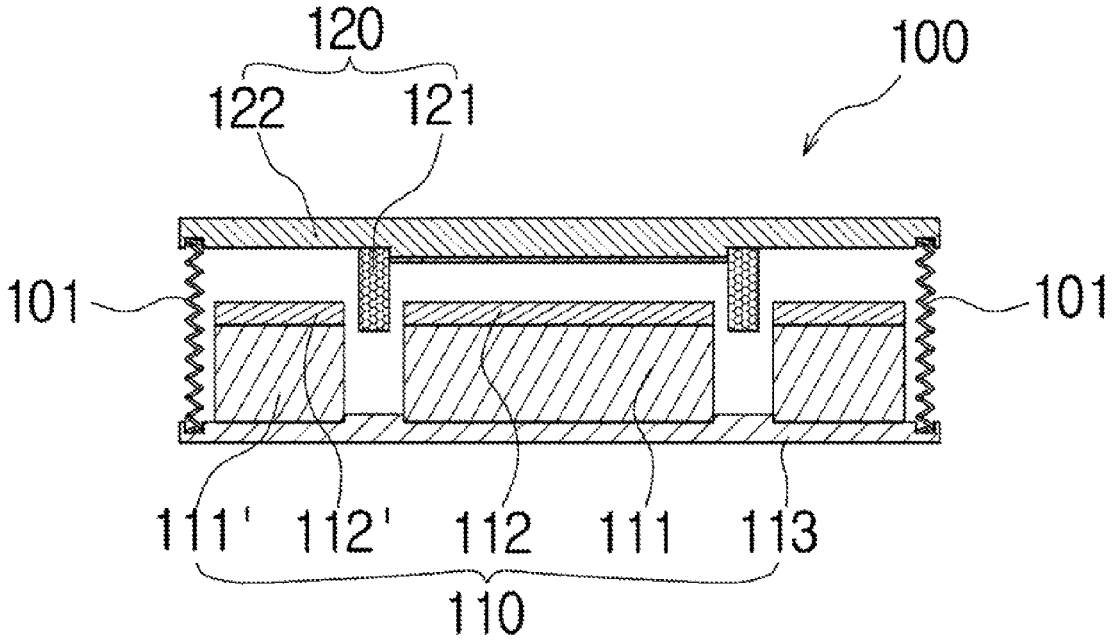
FIG. 11 is a cross-sectional view illustrating the configuration of a sensory signal output apparatus according to a still another embodiment (fifth embodiment) of the present invention.

Next, reviewing Example 5 of the present invention, as illustrated in FIG. 11 of the accompanying drawings, the case 101 may be a coil spring arrangement connected to the edge portion of the surface between the magnetic circuit part 110 and the coil part 120 at an interval.

It is exemplified that the number of arranged coil springs is 3 to 6 as one example. The number of the arranged inclined leaf springs may be increased according to the extent of a magnetic force, an object in which the sensor signal output apparatus is used, or the like.

Figure 12:
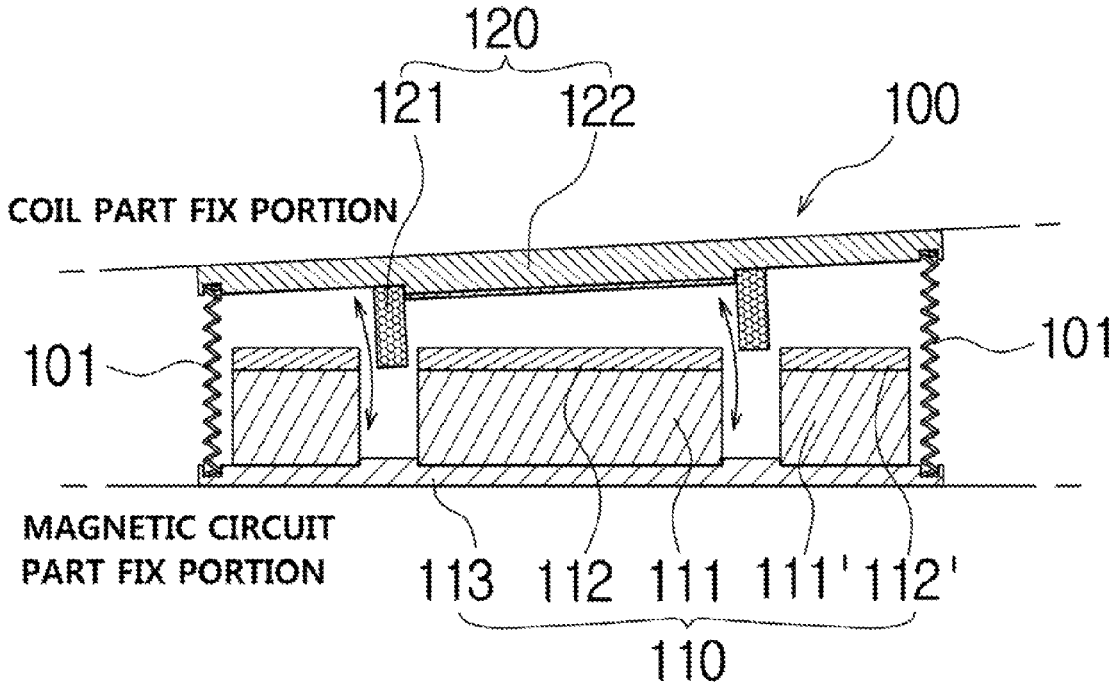
FIG. 12 is a cross-sectional view illustrating an operational state of the sensory signal output apparatus according to the still another embodiment (fifth embodiment) of the present invention.

Thus, as illustrated in FIG. 12 of the accompanying drawings, when a portion to which the magnetic circuit part 110 is fixed, and a portion to which coil part 120 is fixed are not maintained in a horizontal state and are beyond a horizontal line at a predetermined angle, the coil springs may flexibly react to such a situation so that fixing can be performed.

At this time, the number of windings or the degree of elasticity of the coil spring positioned at a portion in which an interval of the surface between the magnetic circuit part 110 and the coil part 120 is narrow may be smaller or lower than the number of windings or the degree of elasticity of the coil spring located at a portion in which an interval of the surface between the magnetic circuit part 110 and the coil part 120 is wide.

Thus, when a portion to which the magnetic circuit part 110 is fixed, and a portion to which coil part 120 is fixed are not maintained in a horizontal state and are beyond a horizontal line at a predetermined angle, the unbalance of elastic forces between a side at which the interval is narrow and a side at which the interval is wide can be prevented from occurring during vibration due to the inclination. Due to this, the distortion of vibration can be prevented.

Figure 13:
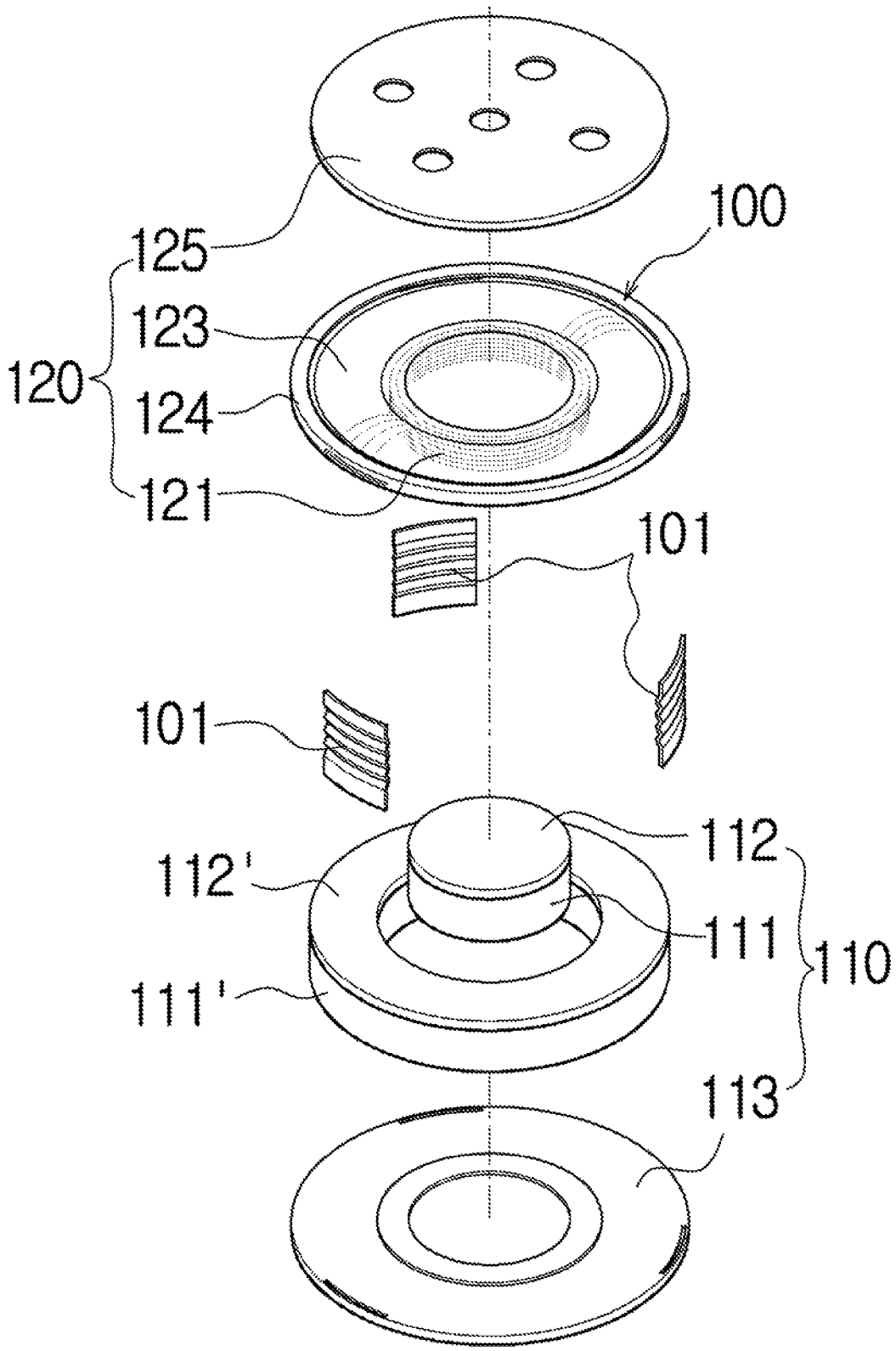
FIG. 13 is an exploded perspective view illustrating the configuration of a sensory signal output apparatus according to a still further embodiment (sixth embodiment) of the present invention.

Lastly, reviewing Example 6 of the present invention, as illustrated in FIG. 13 of the accompanying drawings, the coil part 120 may further include a diaphragm 123 adopted to output a sound by a vibration of the voice coil 121 wherein the voice coil 121 is fixed in the center of one surface of the diaphragm.

In the above case, a rim type support member 124 is disposed on an outer circumferential surface of the diaphragm 123 to which the voice coil 121 is fixed so that a portion coupled to the case 101 can be provided. A cover 125 protecting the diaphragm may be connected to an inner circumferential surface of one opening portion of the rim type support member 124.

Thus, a vibration force generated by vibrations of the magnetic circuit part 110 and the coil part 120 and a sound generated by a vibration of the diaphragm 123 may be simultaneously outputted.

As described above, although the present invention has been explained and illustrated based on the embodiments for exemplifying the principle of the present invention, the elements and operations of the present invention should not be limited to those explained and illustrated above.

For example, the sensory signal output apparatus 100 having the structure as the present invention can perform a bone conduction output. Bone conduction means that a vibration is directly transmitted from the bone to the inner ear without going through air so as to be heard, and that the vibration occurs when a vibrating screen is attached to a head cover or is placed in the cranial bone. When the sensory signal output apparatus is used as a bone conduction output apparatus, it may be applied to an earphone (including a headphone, a back earphone, or the like), may be also used as an acoustic or vibration output apparatus of a smartphone, or may be applied to the temples of sunglasses or glasses. As can be seen from the title of the present invention, the sensory signal output apparatus is not limited to a bone conduction output apparatus, but is available as other vibration and/or acoustic output apparatuses.

In addition, those skilled in the art will appreciate that various modifications, additions and substitutions are possible, without departing from the scope and spirit of the invention as disclosed in the accompanying claims.

Accordingly, all appropriate modification, additions and substitutions, and equivalents should be deemed to fall within the scope of the present invention.

What is claimed is:

1. A sensory signal output apparatus comprising:

a magnetic circuit part;

a coil part; and a case in which the magnetic circuit part and the coil part are accommodated, wherein the sensory signal output apparatus generates a sound or vibration while vibrating, by the magnetic circuit part, depending on a direction of an alternating signal applied to the coil part in a state where the magnetic circuit part and the coil part are accommodated in the case at corresponding positions, and wherein the case elastically supports the magnetic circuit part and the coil part so that the magnetic circuit part and the coil part are operated to repeal or attract each other, or so that in a state where the magnetic circuit part is fixed, the coil part vibrates while performing a repulsion or attraction motion, and in a state where the coil part is fixed, the magnetic circuit part vibrates while performing a repulsion or attraction motion, wherein the case is an elastic plate body in a vertical direction, the elastic plate body being connected to an edge portion of a surface between the magnetic circuit part and the coil part and being made of a metal material or a synthetic resin material.

2. The sensory signal output apparatus of claim 1, wherein the magnetic circuit part comprises: a magnet generating a magnetic force; a top plate laminated on an upper surface of the magnet and adopted to concentrate the magnetic force of the magnet; and a yoke adopted to provide a surface on which the magnet is fixedly seated, and a passage through which a line of magnetic force passes, the yoke having a height surface so as to provide a gap having a magnetic flux formed in a direction of an outer circumferential surface or an inner circumferential surface of the magnet and the top plate.

3. The sensory signal output apparatus of claim 1, wherein the magnetic circuit part comprises:

a magnet generating a magnetic force;

a top plate laminated on an upper surface of the magnet;

another magnet and another top plate having a concentric circle with the magnet and the top plate and disposed in an outer portion at an interval; and a yoke positioned to have the concentric circle and adopted to provide a surface on which the magnets are seated, and a passage through which a line of magnetic force passes.

4. The sensory signal output apparatus of claim 1, wherein the coil part comprises:

a voice coil vibrating according to the Fleming's left-hand law in a state of being positioned at a gap of the magnetic circuit part when an alternating signal is input from the outside; and a plate to which the voice coil 121 is fixed in the center of one surface.

5. The sensory signal output apparatus of claim 1, wherein the coil part comprises:

a voice coil vibrating according to the Fleming's left-hand law in a state of being positioned at a gap of the magnetic circuit part when an alternating signal is input from the outside; and a diaphragm adopted to output a sound by a vibration of the voice coil, wherein the voice coil is fixed in the center of one surface of the diaphragm.

6. The sensory signal output apparatus of claim 1, wherein the case is a plate-body shaped leaf spring arrangement connected to an edge portion of a surface between the magnetic circuit part and the coil part at an interval; or a rim-shaped leaf spring having a pierced portion and an elastic portion arranged an interval; or a rim-shaped leaf spring having elasticity.

7. The sensory signal output apparatus of claim 6, wherein a surface facing the coil part of the magnetic circuit part is one surface of the yoke on which the magnet is fixedly seated, and a surface facing the magnetic circuit part of the coil part is one surface of the plate to which the voice coil is fixed.

8. The sensory signal output apparatus of claim 1, wherein a surface of the leaf spring may be provided with a crumple zone providing an elastic force or a curved surface in an outward direction or an inward direction.

9. The sensory signal output apparatus of claim 1, wherein a surface facing the coil part of the magnetic circuit part is one surface of the yoke on which the magnet is fixedly seated, and a surface facing the magnetic circuit part of the coil part is one surface of the plate to which the voice coil is fixed.

10. The sensory signal output apparatus of claim 1, wherein the case is a leaf spring arrangement connected to an edge portion of a surface between the magnetic circuit part and the coil part at an interval, and having a plate body whose center portion is bent to protrude in an inward direction; a rim-shaped leaf spring connected to the edge portion of the surface between the magnetic circuit part and the coil part, and having a rim whose center portion is bent to protrude in an inward direction, the rim-shaped leaf spring having a pierced portion and an elastic portion arranged on a surface thereof at an interval.

11. The sensory signal output apparatus of claim 1, wherein the case is a leaf spring arrangement connected to the edge portion of the surface between the magnetic circuit part and the coil at an interval, and having a plate body whose center portion is bent to protrude in an outward direction; a rim-shaped leaf spring connected to the edge portion of the surface between the magnetic circuit part and the coil part, having a rim whose center portion is bent to protrude in an outward direction, and having a pierced portion and an elastic portion arranged on a surface thereof at an interval; or a rim-shaped leaf spring connected to the edge portion of the surface between the magnetic circuit part and the coil part, and having a rim whose center portion is bent to protrude in an outward direction.

12. The sensory signal output apparatus of claim 1, wherein the case is an inclined leaf spring arrangement made of a metal material or a synthetic resin material, one of which is connected to a surface facing the coil part of the magnetic circuit part, and another end of which diagonally extends along an outer edge line of the magnetic circuit part and the coil part, thereby the inclined spring arrangement being connected to the surface facing the magnetic circuit part of the coil part.

13. The sensory signal output apparatus of claim 1, wherein a number of windings or a degree of elasticity of a first coil spring positioned at a portion in which an interval of the surface between the magnetic circuit part and the coil part is narrow is smaller or lower than the number of windings or the degree of elasticity of a second coil spring located at a portion in which an interval of the surface between the magnetic circuit part and the coil part is wide.

14. The sensory signal output apparatus of claim 1, wherein the coil part further comprises a diaphragm adopted to output a sound by a vibration of the voice coil, wherein the voice coil is fixed in the center of one surface of the diaphragm, and wherein a rim type support member is connected to an outer circumferential surface of the diaphragm to which one surface of the voice coil is fixed in the center.

* * * * *